US009918888B2

(12) United States Patent
Boggs et al.

(10) Patent No.: US 9,918,888 B2
(45) Date of Patent: Mar. 20, 2018

(54) LOCKING MECHANISM WITH PIVOTABLE FOOT ACTUATION LEVER

(71) Applicant: Medline Industries, Inc., Mundelein, IL (US)

(72) Inventors: Tiffanie Boggs, Chicago, IL (US); Matthew Zlotow, Hanover Park, IL (US); Lisa Bauer, Buffalo Grove, IL (US); Jeff Hunt, Fox River Grove, IL (US)

(73) Assignee: Medline Industries, Inc., Northfield, IL (US)

( * ) Notice: Subject to any disclaimer, the term of this patent is extended or adjusted under 35 U.S.C. 154(b) by 36 days.

(21) Appl. No.: 14/222,348

(22) Filed: Mar. 21, 2014

(65) Prior Publication Data

US 2015/0265480 A1 Sep. 24, 2015

(51) Int. Cl.
*A61G 7/05* (2006.01)

(52) U.S. Cl.
CPC ..... *A61G 7/05* (2013.01); *A61G 7/0528* (2016.11)

(58) Field of Classification Search
CPC ..... B60B 33/021; B60B 2200/242; B60B 33/0078; A61G 2007/0528; A61G 1/0287; A61G 1/0268; A61G 13/02; G05G 1/46; G05G 1/487; G05G 1/32; G05G 7/00; G05G 9/00; B62B 5/04; B62B 5/0433; B62B 5/049
USPC ..... 5/600
See application file for complete search history.

(56) References Cited

U.S. PATENT DOCUMENTS 3,304,116 A * 2/1967 Stryker ..... A61G 7/00 296/20
3,820,838 A * 6/1974 Limpach ..... A61G 7/005 296/20
4,489,449 A * 12/1984 Failor ..... A61G 7/00 5/83.1
4,723,808 A * 2/1988 Hines ..... A61G 7/002 296/20
4,747,180 A * 5/1988 Screen ..... B60B 33/0042 16/33
4,833,972 A * 5/1989 Bohusch ..... A61G 13/10 5/600
4,922,574 A 5/1990 Heiligenthal et al.
(Continued)

OTHER PUBLICATIONS

Attach. (n. d.) Collins English Dictionary—Complete and Unabridged, 12th Edition 2014. (1991, 1994, 1998, 2000, 2003, 2006, 2007, 2009, 2011, 2014). Retrieved Jun. 19, 2016 from http://www.thefreedictionary.com/attach.*
(Continued)

*Primary Examiner* — Nicholas F Polito
*Assistant Examiner* — Amanda L Bailey
(74) *Attorney, Agent, or Firm* — Philip H. Burrus, IV

(57) ABSTRACT

A locking mechanism (100) includes one or more casters (102,103,104,105) coupled to a frame (101). A lift mechanism (106,107) is distally extendable from the frame to elevate the casters. A pivoting bar (108) is pivotable relative to the frame to distally extend the lift mechanism from the frame. A foot pedal (113) is pivotable relative to the pivoting bar between a closed position and an angularly displaced open position. When in the angularly displaced open position, the foot pedal can extend distally from the pivoting bar.

18 Claims, 6 Drawing Sheets

(56) References Cited

U.S. PATENT DOCUMENTS 5,347,682 A * 9/1994 Edgerton, Jr. ..... A61G 7/012 16/32
5,730,494 A * 3/1998 LaPointe ..... A61G 5/14 297/330
5,806,111 A * 9/1998 Heimbrock ..... A61G 1/0287 280/47.371
6,039,147 A * 3/2000 Gillis ..... E06C 1/397 182/15
6,363,556 B1 * 4/2002 Krauska ..... A61G 7/002 5/613
6,473,921 B2 * 11/2002 Brooke ..... A61G 7/012 16/32
6,588,523 B2 * 7/2003 Heimbrock ..... A61G 7/018 180/19.1
6,598,247 B1 * 7/2003 Heimbrock ..... A61G 7/08 296/20
6,792,630 B1 * 9/2004 Palmatier ..... A61G 7/012 280/43.17
6,868,567 B2 3/2005 Edgerton
6,962,233 B2 * 11/2005 Gillis ..... E06C 1/397 182/15
7,293,307 B2 11/2007 Edgerton
7,421,748 B1 9/2008 Edgerton
7,922,183 B2 * 4/2011 Figel ..... A61G 1/0225 280/47.38
8,321,976 B1 12/2012 Edgerton
8,393,026 B2 3/2013 Dionne et al.
8,621,690 B2 1/2014 Hornbach et al.
8,667,628 B1 * 3/2014 Heikkila ..... A47C 19/02 5/11
9,074,648 B2 * 7/2015 Spoor ..... B60T 11/046
2004/0105733 A1 * 6/2004 Hewitt ..... B60P 7/08 410/66
2004/0139545 A1 * 7/2004 Reinke ..... A61G 1/0287 5/86.1
2005/0017117 A1 * 1/2005 Moon ..... B65H 75/403 242/390.8
2006/0082088 A1 * 4/2006 Webster ..... B62B 5/049 280/79.11
2007/0080030 A1 * 4/2007 Kramer ..... B60T 1/14 188/5
2007/0290468 A1 * 12/2007 Martin ..... A61G 5/10 280/47.38
2008/0047065 A1 * 2/2008 He ..... 5/600
2009/0100598 A1 * 4/2009 Bly ..... A47C 20/043 5/510
2010/0077549 A1 * 4/2010 Hensley et al. ..... 5/618
2010/0181122 A1 7/2010 Block et al.
2010/0306921 A1 12/2010 Kramer
2012/0036636 A1 * 2/2012 Stryker et al. ..... 5/600
2012/0233779 A1 9/2012 Bly et al.
2013/0075991 A1 * 3/2013 Satou ..... A61G 5/10 280/43
2013/0318720 A1 * 12/2013 Connell et al. ..... 5/611
2016/0022513 A1 * 1/2016 Spoor ..... B62B 9/082 296/20

OTHER PUBLICATIONS

Base. (n. d.) Random House Kernerman Webster's College Dictionary. (2010). Retrieved Apr. 3, 2017 from http://www.thefreedictionary.com/base.*

"Alterra 1385 Hi-Low Bed", Medline Catalog; http://www.medline.com/catalog/catalog.jsp; Unknown Publication date but believed to be prior to present application filing date.

"Alterra Maxx Bed", Medline Catalog; http://www.medline.com/catalog/catalog.jsp; Unknown Publication date but believed to be prior to present application filing date.

"Amico Apollo Hospital Bed", Medline Catalog; http://www.medline.com/catalog/catalog.jsp; Unknown Publication date but believed to be prior to present application filing date.

"Hill-Rom Advanta Refurbished Hospital Bed", Medline Catalog; http://www.medline.com/catalog/catalog.jsp; Unknown Publication date but believed to be prior to present application filing date.

"Hill-Rom Care Assist Refurbished Hospital Bed", Medline Catalog; http://www.medline.com/catalog/catalog.jsp; Unknown Publication date but believed to be prior to present application filing date.

"Hill-Rom Total Care Refurbished Hospital Bed", Medline Catalog; http://www.medline.com/catalog/catalog.jsp; Unknown Publication date but believed to be prior to present application filing date.

"Hill-Rom Versa Care Refurbished Hospital Bed", Medline Catalog; http://www.medline.com/catalog/catalog.jsp; Unknown Publication date but believed to be prior to present application filing date.

* cited by examiner

LOCKING MECHANISM WITH PIVOTABLE FOOT ACTUATION LEVER

BACKGROUND

Technical Field

This disclosure relates generally to locking mechanisms, and more particularly to locking mechanisms for caster assemblies.

Background Art

For a device that sits on wheels or casters, it can be desirable to provide a locking mechanism that selectively allows a user to prevent the wheels or casters from rolling. These locking mechanisms can be configured as friction devices that selectively rest against the wheels or casters to prevent them from turning. Alternatively, the locking mechanism can prevent an axle connected to the wheels or casters from turning. Motion transfer locks have even been developed for preventing hospital beds and other objects supported by wheels or casters from moving. These motion transfer locks "lock" the bed or other object by raising the wheels or casters off the ground.

Prior art locking mechanisms can be difficult and cumbersome to operate. It would be advantageous to have an improved locking mechanism suitable for use on hospital beds and other devices.

Figure 1:
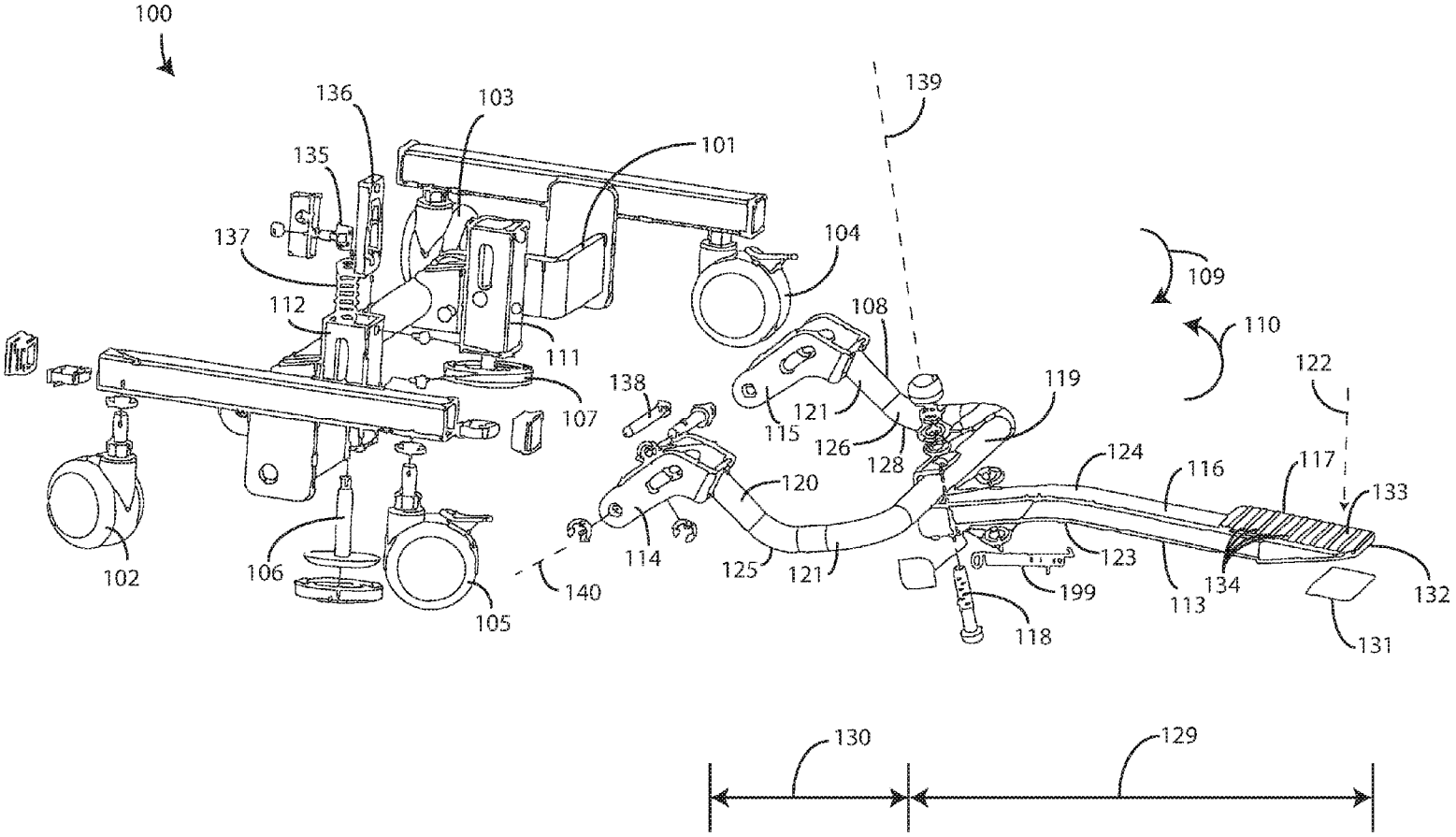
FIG. 1 illustrates an exploded view of one explanatory locking mechanism in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion.

For example, talking about a device (10) while discussing figure A would refer to an element, 10, shown in figure other than figure A.

Embodiments of the disclosure provide a locking mechanism suitable for use with a frame supported by one or more casters coupled thereto. In one embodiment, a lift mechanism is distally extendable from the frame to elevate the casters so that a device attached to the frame, such as a hospital bed, does not roll. A pivoting bar is pivotable relative to the frame to distally extend the lift mechanism from the frame to elevate the casters.

To make the locking mechanism simpler to use, in one or more embodiments a foot pedal is pivotable relative to the pivoting bar. In one embodiment, the foot pedal can pivot between a closed position and an angularly displaced open position in which an extension arm of the foot pedal extends distally from the pivoting bar. The term "angularly displaced" refers to the fact that the foot pedal pivots to an open position that is angularly displaced from the closed position. This can mean that the foot pedal pivots to a position that is angularly displaced from other components of the locking mechanism as well.

When the locking mechanism is used with a hospital bed that can be raised and lowered, for example, pivoting the foot pedal to the angularly displaced open position makes it easier to elevate the casters when the hospital bed is in the lowered position. At the same time, returning the foot pedal to the closed position once the casters are elevated can help to prevent those walking by an end of the bed from tripping.

Turning now to FIG. 1, illustrated therein is an exploded view of a locking mechanism 100 configured in accordance with one or more embodiments of the disclosure. A frame 101 is coupled to one or more casters 102,103,104,105. The frame 101 can be used to support objects coupled thereto. For example, in one embodiment that will be described in more detail with reference to FIG. 4, the frame 101 can be used to support a hospital bed. The casters 102,103,104,105 allow the hospital bed and frame 101 to move along a floor or other flat surface. It should be noted that a hospital bed is used for explanation purposes only. It will be clear to those of ordinary skill in the art having the benefit of this disclosure that any number of other objects, including chairs, desks, equipment, can be coupled to the frame 101 instead of a hospital bed.

To selectively prevent the casters 102,103,104,105 from allowing the hospital bed or other object from moving, one or more lift mechanisms 106,107 are distally extendable from the frame 101 to elevate the casters 102,103,104,105 from the floor or other surface upon which they are resting. A pivoting bar 108 is pivotable relative to the frame 101 to distally extend the lift mechanisms 106,107 from the frame 101 to elevate the casters 102,103,104,105. In one embodiment, the pivoting bar 108 is pivotable relative to the frame 101 about a first axis 139.

When the pivoting bar 108 pivots downward 109 relative to the frame 101 about the first axis 139, the lift mechanisms 106,107 extend distally downward from the frame 101, thereby elevating the casters 102,103,104,105. When the pivoting bar 108 is pushed downward again relative to the frame 101 about the first axis 139 to disengage the locking mechanism, the lift mechanisms 106,107 are allowed to retract into housing members 111,112, thereby allowing the casters 102,103,104,105 to rest against the floor or other surface so that the hospital bed or other object coupled to the frame 101 may again roll. The pivoting bar 108 then releases upward 110 to its default position so the process can start anew.

In one embodiment, a foot pedal 113 is pivotable relative to the pivoting bar 108 between a closed position, as will be shown in more detail with reference to FIG. 2 below, and an angularly displaced open position in which the foot pedal 113 extends distally from the pivoting bar 108, as will be shown in more detail with reference to FIG. 3 below. In one embodiment, the foot pedal 113 is pivotable relative to the pivoting bar 108 about a second axis 140. In this illustrative embodiment, the second axis 140 is aligned substantially orthogonally relative to the first axis 139.

In one embodiment the foot pedal 113 comprises an extension arm 116 and a pedal 117. The extension arm 116 can be coupled to the pivoting bar 108 by a hexagon screw 118 or other linking member. The extension arm 116 can pivot about the hexagon screw 118, thereby allowing the foot pedal 113 to pivot between the closed position and the angularly displaced open position.

Advantageously, the foot pedal 113 serves a number of functions. To begin, pivoting the foot pedal 113 to the angularly displaced open position provides mechanical advantage in that a user can place additional leverage on one or more pin and follower fulcrum devices 114,115 to which the pivoting bar 108 is attached. This additional leverage makes it easier for a user to cause the lift mechanisms 106,107 to lift the casters 102,103,104,105 from the floor or other surface. Said differently, in one embodiment pivoting bar 108 defines a lever and the foot pedal 113 is to increase the leverage of forces 122 applied to the pedal 117 of the foot pedal 113 when the foot pedal 113 is in the angularly displaced open position.

A second advantage provided by the foot pedal 113 is that it can be pivoted to the angularly displaced open position to make elevation of the casters 102,103,104,105 easier when a hospital bed is in a lowered position. As will be described in more detail below with reference to FIG. 4, in one embodiment the frame 101 is used to support a hospital bed. The hospital bed can include one or more foldable legs to permit the upper surface of the bed to transition from a lowered position adjacent to the frame to a raised position extended vertically from the frame. The upper surface can define a head end and a foot end. Two frames can be used to support the bed, with one being disposed toward the head end and one being disposed toward the foot end. When the bed is in a lowered position, it can be difficult to reach the pivoting bar 108. However, in one embodiment the extension arm 116 is configured to be sufficiently long that, when the foot pedal 113 is in the angularly displaced open position, for the pedal 117 to extend beyond the foot end of the bed. Thus, by pivoting the foot pedal 113 to the angularly displaced open position, a user may simply pivot downward 109 the pivoting bar 108 by stepping on the pedal 117. The foot pedal 113 may then be kicked or otherwise moved to the closed position until it is needed again.

A third advantage provided by the foot pedal 113 is the elimination of a tripping hazard. In one or more embodiments, the pivoting bar 108 is configured not to extend beyond the foot end of the hospital bed because doing so would create a tripping hazard for users passing by the foot end of the bed. The pivoting nature of the foot pedal 113 relative to the pivoting bar allows the foot pedal 113 to extend beyond the foot end of the bed when needed, but safely tucked under otherwise to eliminate any tripping hazard.

In one embodiment, the pivoting bar 108 defines a U-shape. As shown in FIG. 1, a central portion 119 of the pivoting bar 108 defines the base portion of the U-shape, while two extension portions 120,121 of the pivoting bar 108 define the arms of the U-shape. In this illustrative embodiment, the foot pedal 113 is coupled to the base of the U-shape. Moreover, in this illustrative embodiment the foot pedal 113 is centrally disposed along the base of the U-shape. Said differently, in one embodiment the foot pedal 113 is coupled about to the center of the central portion 119 of the pivoting bar 108. It will be obvious to those of ordinary skill in the art having the benefit of this disclosure that other coupling configurations can be used in other embodiments or applications.

While a U-shape is one shape for a pivoting bar 108 configured in accordance with one or more embodiments of the disclosure, it will be obvious to those of ordinary skill in the art having the benefit of this disclosure that other shapes can be used as well. For example, in another embodiment the pivoting bar 108 could be a L-shape, with one extension portion 121 or the other extension portion 120 of the U-shape removed. Similarly, the pivoting bar 108 could be linear. For example, the foot pedal 113 could be coupled to extension portion 120 only. Another foot pedal could be coupled to extension portion 121 while central portion 119 is removed. These are just a few examples of the various shapes that a pivoting bar configured in accordance with embodiments of the disclosure could include.

In one embodiment, the extension arm defines a bend 123 between the pivoting bar 108 and the pedal 117. In one embodiment, the bend 123 is between five and thirty degrees. The illustrative bend 123 of FIG. 1 is about twenty degrees. Moreover, the illustrative bend 123 of FIG. 1 is convex up, meaning that the apex 124 of the bend 123 is pointing up.

In one embodiment, the pivoting bar 108 also includes the bend. For example, in the illustrative embodiment of FIG. 1, each arm of the U-shape, i.e., the extension portions 120,121 of the pivoting bar 108, each comprise a bend 125,126. In the illustrative embodiment of FIG. 1, the bend 125,126 of the arms of the U-shape is convex down, meaning that the apex 127,128 of each bend 125,126 is pointing down. Accordingly, in this illustrative embodiment, the bend 123 of the foot pedal 113 and the bend 125,126 of the arms of the U-shape are convex relative to each other. The apex 124 of one bend 123 points toward the apex 127,128 of the other bend 125,126.

In one embodiment, a length 129 of the extension arm 116 is greater than a length 130 of the pivoting bar 108. Accordingly, when the foot pedal 113 is pivoted to the angularly disposed open position, the lever formed by the pivoting bar 108 and the foot pedal 113 more than doubles in length compared to when the foot pedal 113 is pivoted to the closed position.

In one embodiment, a rubber pad 131 is disposed at the distal end 132 of the foot pedal 113. In this embodiment, the rubber pad 131 is disposed on the bottom side of the pedal 117. The rubber pad 131 can be attached to the foot pedal 113 by adhesives or other fastening devices. Advantageously, placing the rubber pad 131 on the bottom of the pedal 117 prevents the foot pedal 113 from doing any damage to a floor or other surface if the pedal 117 inadvertently strikes the floor or other surface when the lift mechanism 106,107 elevates the casters 102,103,104,105.

In one embodiment, the pedal 117 comprises a surface 133 defining a plurality of convex ridges 134. Advantageously, the plurality of convex ridges 134 can prevent slippage of a user's foot along the surface 133 of the pedal 117. A tension spring 199 can be disposed between the frame 101 and the foot pedal 113 to apply a loading force to retain the foot pedal 113 in one of the closed position, the angularly displaced open position, or combinations thereof.

In one embodiment, the locking mechanism 100 can works as a motion transfer mechanism to elevate the frame 101 and casters 102,103,104,105 off the floor or other surface. In one embodiment, each housing member 111,112 can include a rotatably mounted clip assembly 135 and corresponding chucking plate 136 with one or more catches disposed thereon. A spring 137 can be provided to bias the lift mechanism 106,107 into the housing members 111,112 in a default position.

Each lift mechanism 106,107 is disposed within a channel defined by the housing members 111,112. A pin 138 positioned in a follower coupled to a follower fulcrum device 114 to serve as a drive member for the corresponding lift mechanism 106. When the pivoting bar 108 is pivoted downward 109, the pin 138 drives the corresponding lift mechanism 106 downward vertically from the housing member 111.

The clip assembly 135 is mounted within the housing member 111 between the pin 138 and the lift mechanism 106. The clip assembly 135 can selectively latch and release from the catches of the chucking plate 136 when the pin 138 drives the lift mechanism downward. Illustrating by example, the clip assembly 135 can slide across flat portions of the chucking plate 136 and latch on a first catch or a second catch as the pivoting bar 108 pivots downward 109. By continuing to drive the pin 138 downward, the clip assembly 135 can release from all latches so that the spring 137 can return the lift mechanism 106 back into the housing member 111 to again place the casters 102,103,104,105 on the floor or other surface. Note that while the action described here and below is with reference to lift mechanism 106 for simplicity, a corresponding configuration can apply to lift mechanism 107.

The lift mechanism 106 is initially in its default position with the spring 137 biasing the lift mechanism 106 into the housing member 111. In one embodiment, the spring 137 biases the lift mechanism 106 upward so that the clip assembly 135 catches on an uppermost default catch. The casters 102,103,104,105 thus rest on the floor or other surface.

As the pivoting bar 108, and in one or more embodiments in response to a force 122 applied to the foot pedal 113, pivots downward, the lift mechanism 106 extends distally from the housing member 111 and thus from the frame 101. When the lift mechanism 106 is initially driven distally downward, the clip assembly 135 releases from any catch to which it was connected and slides along flat portions of the chucking plate 136 until it passes over another catch to latch thereto, thereby elevating the casters 102,103,104,105. Continued movement of the pivoting bar 108 in the downward direction continues this process to further elevate the casters 102,103,104,105 as the clip assembly 135 catches on additional catches of the chucking plate 136. After the last catch, additional movement of the pivoting bar 108 downward causes the clip assembly 135 to pass the final latch. At this point, the clip assembly 135 is released to return to the default catch in response to action by the spring 137, thereby retracting the lift mechanism 106 back into the housing member 111. This process allows the casters 102,103,104,105 to be elevated in predetermined amounts according to the spacing of catches along the chucking plate 136. The casters 102,103,104,105 can then be lowered with an additional movement of the pivoting bar 108 to start the process anew.

Figure 2:
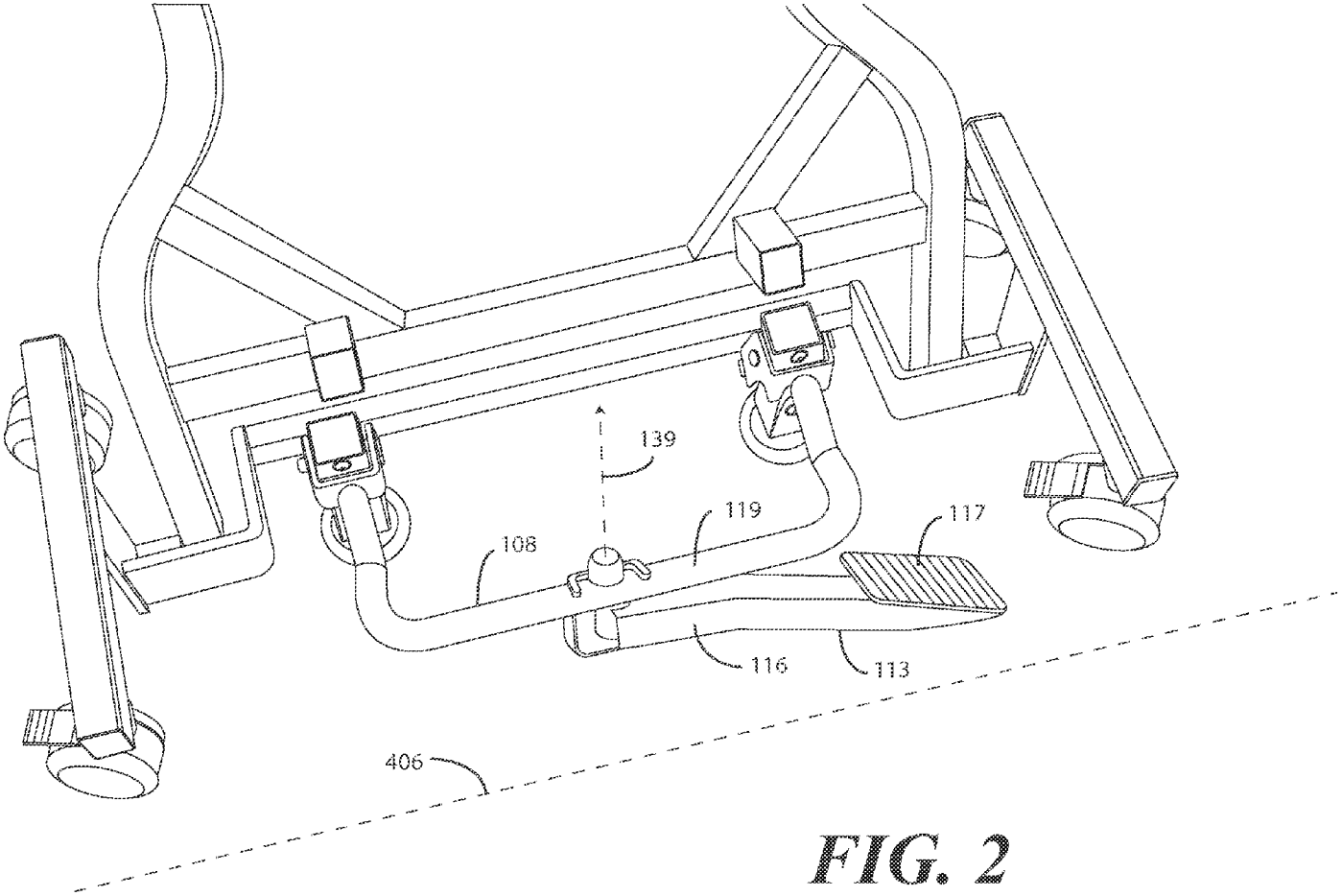
FIG. 2 illustrates one explanatory locking mechanism in accordance with one or more embodiments of the disclosure.
Figure 3:
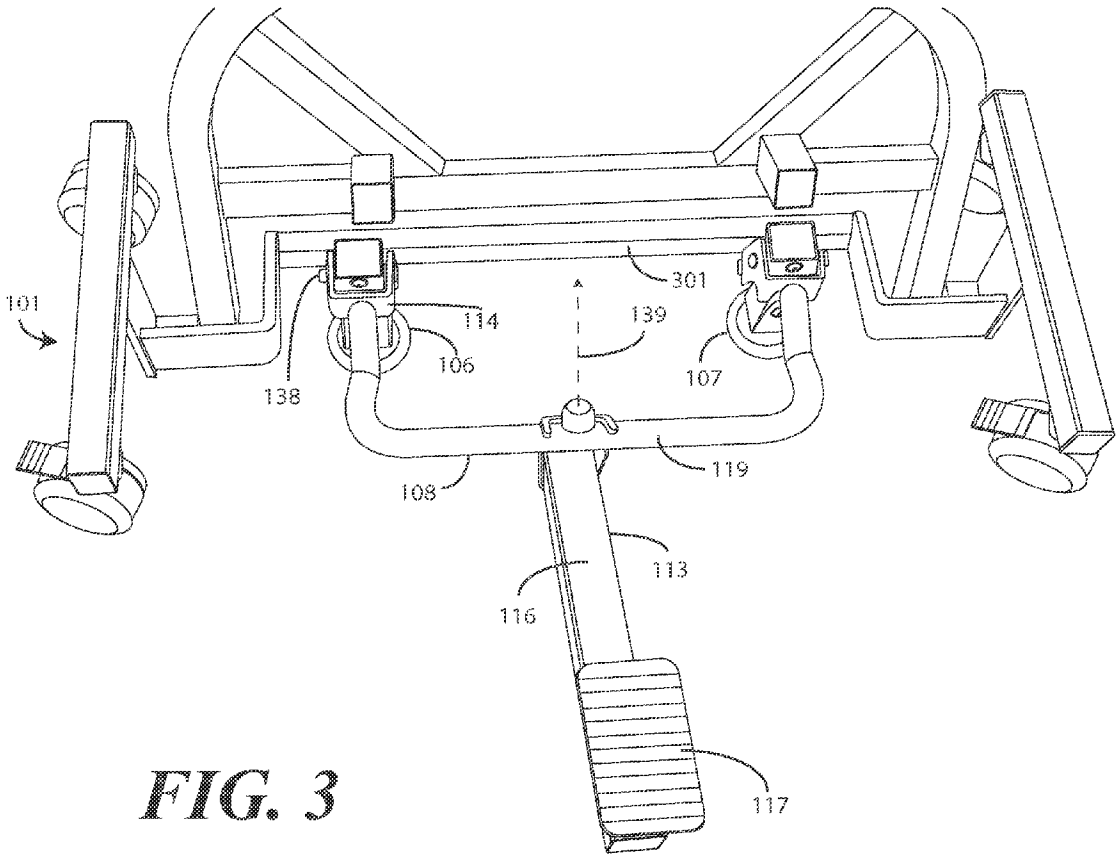
FIG. 3 illustrates one explanatory locking mechanism in accordance with one or more embodiments of the disclosure.

FIGS. 2 and 3 illustrate the foot pedal 113 in the closed position and angularly displaced open position, respectively. Beginning with FIG. 2, illustrated therein is the foot pedal 113 pivotally coupled to the pivoting bar 108. The foot pedal 113 is rotated to the closed position. In this illustrative embodiment, when the foot pedal 113 is in the closed position, the extension arm 116 is oriented substantially parallel with the base of the U-shape of the pivoting bar 108, i.e., substantially parallel with the central portion 119 of the pivoting bar 108. As noted above, a spring (137) can be used to apply a biasing force working to retain the foot pedal 113 in the closed position.

Turning now to FIG. 3, the foot pedal 113 has been pivoted about the second axis 140 relative to the pivoting bar 108 to the angularly displaced open position. Where a spring (137) was optionally used to retain the foot pedal 113 in the closed position, the force required to pivot the foot pedal 113 about the second axis 140 to the angularly displaced open position would need to be sufficient to overcome the preloading or biasing force applied by the spring (137).

In this illustrative embodiment, when the foot pedal 113 is in the angularly displaced open position, the extension arm 116 is oriented substantially orthogonal with the base of the U-shape of the pivoting bar 108, i.e., substantially orthogonal with the central portion 119 of the pivoting bar 108. Said differently, in this illustrative embodiment the angularly displaced open position is angularly displaced by about ninety degrees from the closed position shown in FIG. 2. This amount of angular displacement works well when the central portion 119 of the U-shape of the pivot bar is generally parallel to main support 301 of the frame 101. Those of ordinary skill in the art having the benefit of this disclosure will find it obvious that other amounts of angular displacement can be used as well. For example, if the pivoting bar 108 were a single bar extending perpendicularly away from the main support 301 of the frame 101, the closed position may be angularly displaced ninety degrees relative to the pivoting bar 108, while the angularly displaced open position was angularly displaced 180 degrees from the pivoting bar 108.

As noted above, a tension spring (199) can be used to apply a biasing force working to retain the foot pedal 113 in the angularly displaced position. A user may now apply a foot to the pedal 117 to cause the pin 138 of the follower fulcrum device 114 to actuate the lift mechanism 106. A similar process occurs to actuate lift mechanism 107.

Figure 4:
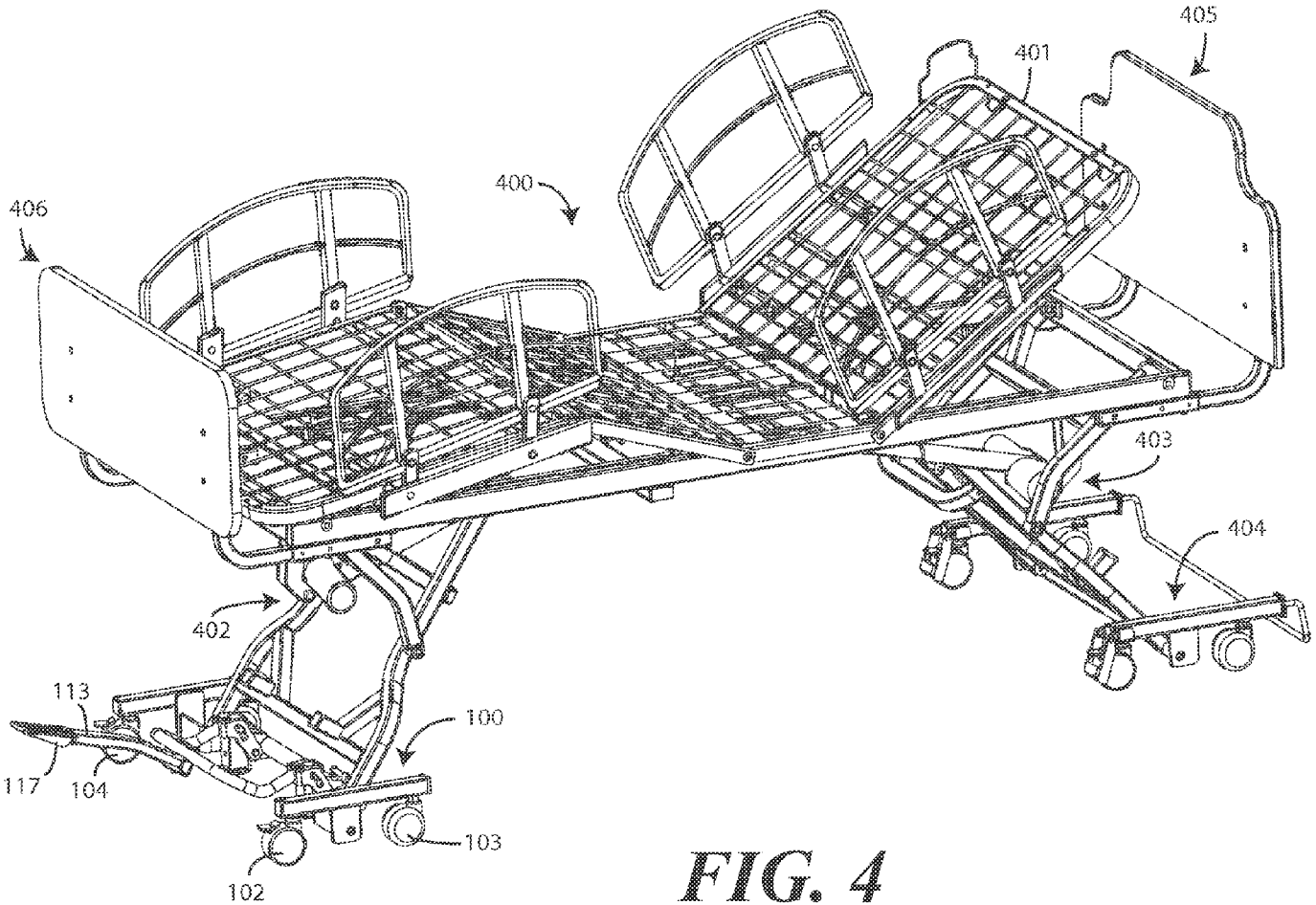
FIG. 4 illustrates an apparatus with one explanatory locking mechanism in accordance with one or more embodiments of the disclosure.

Turning now to FIG. 4, illustrated therein is the locking mechanism 100 coupled to an apparatus. The illustrative apparatus of FIG. 4 is a hospital bed 400, which will be used for illustrative purposes. It will be obvious to those of ordinary skill in the art having the benefit of this disclosure that other apparatuses can be substituted for the hospital bed 400. For example, the locking mechanism 100 could be used to support a chair, desk, table, cabinet, or other item.

The hospital bed 400 includes a surface 401 for supporting a mattress or other sleeping surface. Beneath the surface 401 is a first folding leg structure 402 and a second folding leg structure 403. The first folding leg structure 402 and the second folding leg structure 403 permit the surface 401 of the hospital bed 400 to transition from a lowered position where the surface 401 is adjacent to the frame 101, which is shown in FIG. 4, to a raised position where the surface 401 is extended vertically from the frame 101 as shown in FIG. 1. The casters 102,103,104,(105) are then able to rest on a floor or other surface to support the hospital bed 400. A second caster assembly 404 can be provided as well. The second caster assembly 404 can be configured as a locking mechanism in accordance with embodiments of the disclosure as well. Alternatively, the second caster assembly 404 can be freewheeling, as one locking mechanism 100 is sufficient to prevent the hospital bed 400 from rolling in one or more embodiments.

In one embodiment, the hospital bed 400 defines a head end 405 and a foot end 406. In the illustrative embodiment of FIG. 4, the locking mechanism 100 is disposed toward the foot end 406. The second caster assembly 404 is disposed toward the head end 405. Accordingly, the locking mechanism 100 of this embodiment is disposed closer to the foot end 406 than the head end 405. In one embodiment, the position of the locking mechanism 100 is such that the pedal 117 of the foot pedal 113 is disposed beneath the surface 401 when the foot pedal 113 is in the closed position. Returning briefly to FIG. 2, where the foot pedal 113 is in the closed position, it is shown that the pedal 113 is under the foot end 406, and thus under the surface (401). Advantageously, this "tuck and stow" of the foot pedal beneath the surface (401) eliminates tripping hazards. A user can walk past the foot end 406 without being tripped on items extending therefrom.

Figure 5:
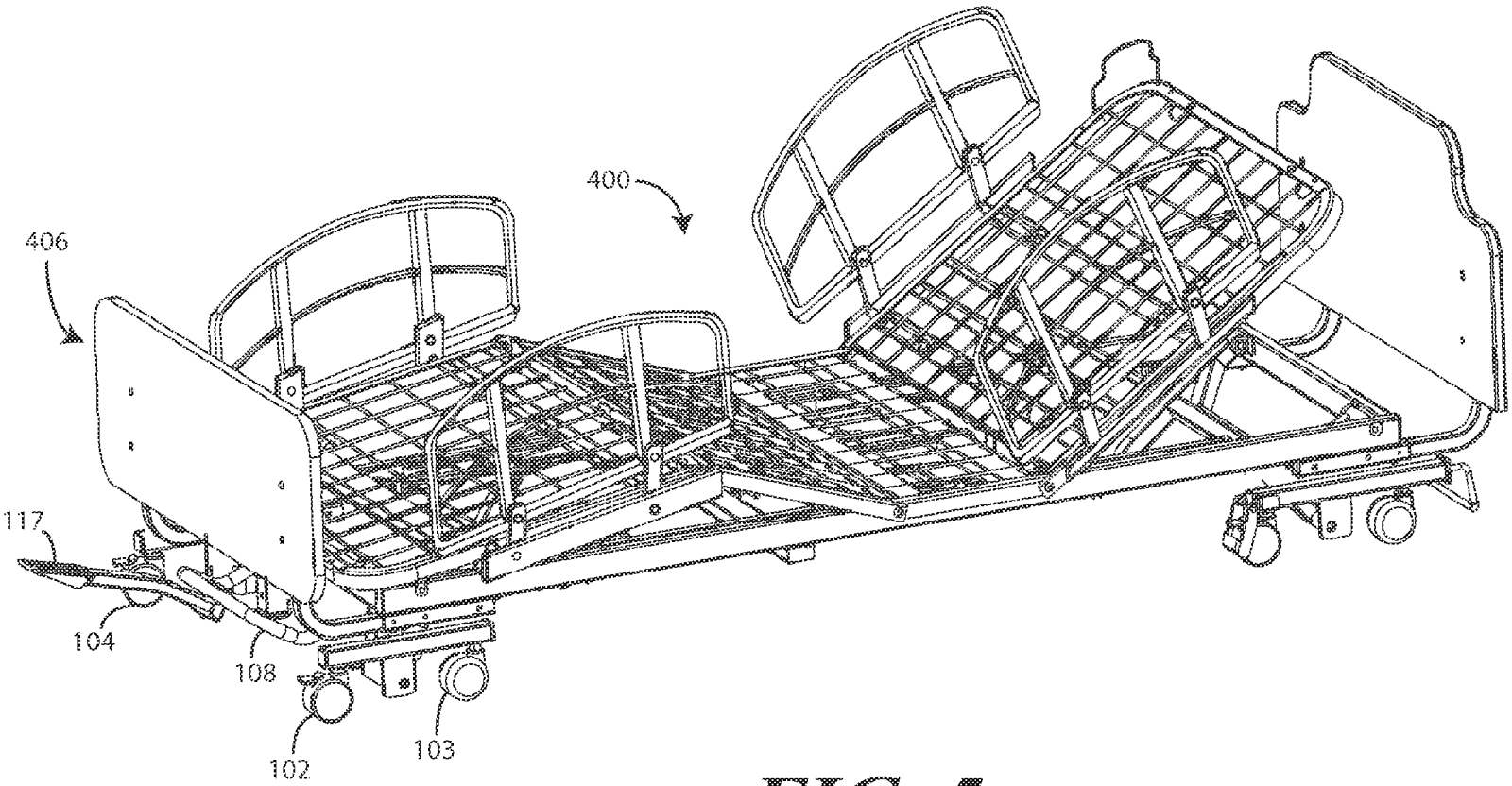
FIG. 5 illustrates the apparatus with one explanatory locking mechanism in accordance with one or more embodiments of the disclosure in a different position.

By contrast, returning now to FIG. 4, when the foot pedal 113 is pivoted to the angularly displaced open position, the pedal 117 extends beyond the foot end 406 of the hospital bed 400. This provides easy access to the pedal 117 for a user to lock and unlock the bed. This access is especially beneficial when the hospital bed 400 is in the lowered position as shown in FIG. 5. In one or more embodiments, the locking mechanism includes a positive lock that engages when the foot pedal 113 is extended or retracted to keep the foot pedal 113 from inadvertently pivoting back. For example, in one embodiment the positive lock feature will basically be a dimple that locks the foot pedal 113 in the open or closed position. Other locking mechanisms will be obvious to those of ordinary skill in the art having the benefit of this disclosure.

Turning to FIG. 5, it can be seen that accessing the pivoting bar 108 is problematic in that a user must get on hands and knees to reach under the foot end 406 of the hospital bed 400 to reach the pivoting bar 108. Moreover, in such a position the user may not be able to provide sufficient leverage to the pivoting bar 108 to elevate the casters 102,103,104,(105). Advantageously, when the foot pedal is pivoted to the angularly displaced open position, the pedal 117 becomes easily accessible. This allows a user to step on the pedal 117 from a standing position. This position allows, if necessary, the user to apply their full body weight to the pedal 117 to elevate the casters 102,103,104,(105) in one or more embodiments. This can assist small framed or weak users in easily and conveniently elevating the casters 102, 103,104,(105).

Figure 6:
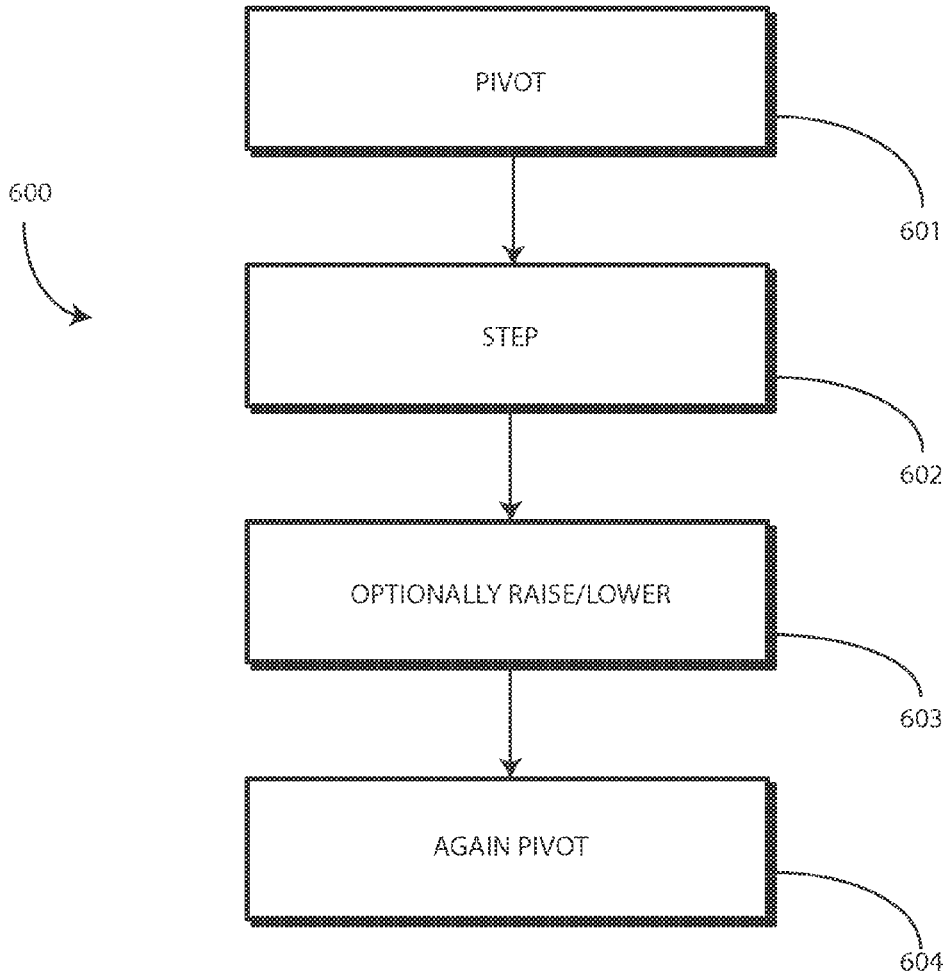
FIG. 6 illustrates one method in accordance with one or more embodiments of the disclosure.

The steps that a user takes to manipulate the locking mechanism 100 in one embodiment are illustratively shown in FIG. 6. Turning now to FIG. 6, illustrated therein is a method 600 for preventing a bed from rolling in accordance with one or more embodiments.

At step 601, the method 600 pivots a foot pedal relative to a pivoting bar until the foot pedal extends from an end of the bed. In one embodiment, the end is the foot end. In one embodiment, step 601 results in a rotation of the foot pedal from a closed position to an angularly displaced open position. In one embodiment, step 601 occurs while the bed is in the lowered position for the advantageous reasons outlined above.

At step 602, the method 600 applies force to a pedal of the foot pedal to cause a lift mechanism to lift one or more casters. This step 602 prevents the bed from rolling as the lift mechanisms provide a friction coupling to the floor or surface upon which the bed is resting.

At optional step 603, the bed can be raised to an elevated position. Alternatively, where step 601 occurs when the bed is in the raised position, step 603 can comprise lowering the bed to the lowered position. At step 604, the method 600 again pivots the foot pedal relative to the pivoting bar until the foot pedal is disposed beneath the bed so as to eliminate any tripping hazard for persons walking near the bed. In one embodiment, this step 604 includes pivoting the foot pedal relative to the pivoting bar until an extension arm of the foot pedal is substantially parallel with an interior section of the pivoting bar.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. An apparatus, comprising: one or more casters coupled to a frame; a lift mechanism distally extendable from the frame to elevate the one or more casters; a pivoting bar pivotable relative to the frame to distally extend the lift mechanism from the frame; and a foot pedal attached to the pivoting bar by a fastener and pivotable about the fastener relative to the pivoting bar between a closed position and an angularly displaced open position extending distally from the pivoting bar; the pivoting bar defining a U-shape comprising two arms rigidly connected by a base, the foot pedal coupled to the pivoting bar at the base of the U-shape.

2. The apparatus of claim 1, the pivoting bar pivotable relative to the frame about a first axis, the foot pedal pivotable relative to the pivoting bar about a second axis, the first axis and the second axis aligned substantially orthogonally relative to each other.

3. The apparatus of claim 1, the foot pedal comprising an extension arm and a pedal, the extension arm substantially parallel with the base of the U-shape when the foot pedal is in the closed position.

4. The apparatus of claim 1, the foot pedal comprising an extension arm and a pedal, the extension arm substantially orthogonal with the base of the U-shape when the foot pedal is in the angularly displaced open position.

5. The apparatus of claim 1, the foot pedal comprising an extension arm and a pedal, the extension arm defining a bend between the pivoting bar and the pedal of between five and thirty degrees.

6. The apparatus of claim 5, each arm of the U-shape defining another bend, the bend and the another bend convex relative to each other.

7. The apparatus of claim 1, the foot pedal comprising an extension arm and a pedal, a length of the extension arm greater than another length of each arm of the U-shape.

8. The apparatus of claim 1, the pivoting bar defining a lever, the foot pedal to increase leverage of forces applied to the foot pedal when the foot pedal is in the angularly displaced open position.

9. The apparatus of claim 1, further comprising a rubber pad disposed at a distal end of the foot pedal relative to the pivoting bar.

10. The apparatus of claim 1, the angularly displaced open position angularly displaced about ninety degrees from the closed position.

11. The apparatus of claim 1, the foot pedal comprising an extension arm and a pedal, the pedal comprising a surface defining plurality of convex ridges.

12. The apparatus of claim 1, further comprising a tension spring disposed between the foot pedal and the frame to apply a loading force to retain the foot pedal in one of the closed position or the angularly displaced open position.

13. The apparatus of claim 1, the fastener comprising a screw defining an axis that is substantially orthogonal to the pivoting bar.

14. A bed, comprising: a surface for supporting a mattress; one or more casters coupled to a frame; one or more foldable legs to permit the surface to transition from a lowered position to a raised position; a pivoting bar pivotable relative to the frame about a first axis to lift the one or more casters; and a foot pedal, attached to the pivoting bar by a linking member defining a second axis, the foot pedal pivotable relative to the pivoting bar about the axis between a closed position parallel with a portion of the pivoting bar and an angularly displaced open position orthogonal with the portion of the pivoting bar; wherein the first and second axes are skew or orthogonal relative to each other.

15. The bed of claim 14, the foot pedal comprising an extension arm and a pedal, the pedal extending beyond an end of the bed when the foot pedal is in the angularly displaced open position and the surface is in the lowered position.

16. The bed of claim 15, the pedal comprising a rubber pad coupled thereto.

17. The bed of claim 15, the pedal disposed beneath the surface when the foot pedal is in the closed position.

18. The bed of claim 14, the surface defining a head end and a foot end, the frame disposed closer to the foot end than the head end.

* * * * *